US008529160B2

(12) United States Patent
Ambriz

(10) Patent No.: US 8,529,160 B2
(45) Date of Patent: Sep. 10, 2013

(54) BULK ABRASIVE HOPPER

(76) Inventor: Steven Richard Ambriz, Missouri City, TX (US)

( * ) Notice: Subject to any disclaimer, the term of this patent is extended or adjusted under 35 U.S.C. 154(b) by 420 days.

(21) Appl. No.: 12/771,936

(22) Filed: Apr. 30, 2010

(65) Prior Publication Data

US 2011/0056964 A1 Mar. 10, 2011

Related U.S. Application Data

(63) Continuation-in-part of application No. 29/301,241, filed on Feb. 19, 2008, now abandoned.

(51) Int. Cl.
*B65G 53/60* (2006.01)

(52) U.S. Cl.
USPC ..... 406/174; 406/151; 406/163

(58) Field of Classification Search
USPC ..... 406/163, 168, 174, 151
See application file for complete search history.

(56) References Cited

U.S. PATENT DOCUMENTS

| | | | | | |
|---|---|---|---|---|---|
| 2,704,229 | A * | 3/1955 | Snow | 406/163 |
| 3,489,464 | A * | 1/1970 | Delfs | 406/28 |
| 3,884,528 | A * | 5/1975 | Shaddock | 406/115 |
| 4,005,908 | A * | 2/1977 | Freeman | 406/25 |
| 4,168,864 | A * | 9/1979 | Weeks | 406/23 |
| 4,571,143 | A * | 2/1986 | Hellerich | 414/523 |
| 4,665,956 | A * | 5/1987 | Freeman | 141/5 |
| D295,339 | S * | 4/1988 | Culshaw | D34/28 |
| 4,834,544 | A * | 5/1989 | Paul | 366/101 |
| D343,489 | S * | 1/1994 | Friesen et al. | D34/28 |
| 5,769,572 | A * | 6/1998 | Pfeiffer | 406/153 |
| 5,785,464 | A * | 7/1998 | May et al. | 406/163 |
| 6,039,513 | A * | 3/2000 | Law | 406/171 |
| D431,889 | S * | 10/2000 | Jansen et al. | D34/28 |
| 6,179,070 | B1 * | 1/2001 | Dietzen | 175/66 |
| D438,683 | S * | 3/2001 | Eltvedt | D34/19 |
| 6,224,297 | B1 * | 5/2001 | McCann et al. | 406/50 |
| 8,157,484 | B2 * | 4/2012 | Dietrich | 406/171 |
| 2012/0006762 | A1 * | 1/2012 | McCabe | 210/801 |

* cited by examiner

*Primary Examiner* — Joseph A Dillon, Jr.

(57) ABSTRACT

A hopper system for both delivery and reclamation of bulk abrasives includes a closed, vacuum rated container with an inlet port with a hatch which is moveable between an open position for gaining access to the interior of the container and a closed position for closing the container. At its lower end there is an outlet port for releasing the contents of the container. The outlet port includes a valve which is moveable between open and closed positions for controlling the flow of contents from the container. The hopper system includes a connector for attaching a vacuum source to the container and in communication with the interior of the container and a reclamation inlet in the container and communicating with a reclamation line for drawing abrasives into the interior of the container when the vacuum source is attached to the container.

6 Claims, 8 Drawing Sheets

BULK ABRASIVE HOPPER

CROSS REFERENCE TO RELATED APPLICATION

This application is a continuation in part of application Ser. No. 29/301,241, filed on Feb. 19, 2008 now abandoned, entitled "Abrasive Storage Hopper", and priority is claimed. Said application is incorporated by reference herein.

BACKGROUND OF THE INVENTION

1. Field of the Invention

The invention is generally related to the storage, transportation, delivery and reclamation of abrasives and is specifically directed to the storage, transportation, delivery and reclamation of abrasive in bulk quantities.

2. Discussion of the Prior Art

Typically abrasives used in abrasive blasting systems are stored in bulk bags often referred to as supersacs. These are fabric bags are shipped on standard wooden pallets. Such bags may have a substantial capacity, even as much as 30 cubic feet or more. The bags of abrasives are shipped side by side on the beds of over-the-road trucks. Generally, there are four sewn fabric straps on the top corners of the bags for handling, typically with forklifts. The forklifts transport the bags onsite and lift the bags above the blast pot, typically a bulk unit built with an opening at the center. At the bottom of each bag is a fabric spout tied shut with a chord. Once the spout has been positioned inside the opening in the top of the blast pot, the chord is removed thus allowing the spout to fully open and the contents of the bag to gravity flow into the blast pot. There is a potential hazard because the operator must cut or pull the draw chord to open the spout. In doing so, they have to place themselves under the bulk bags, which may weigh as much as 4500 lbs. A failure with one the fabric straps could cause serious injury.

After blasting, the used abrasive on the ground is either vacuumed or mechanically collected into a large container similar to a large waste bin. The used abrasive bin is then either shipped to be cleaned and reused or disposed.

In some applications, a bulk bag or supersac rack is utilized to protect the operator. The rack is basically a support frame that is secured on top of the blast pot with four legs. It typically has a bottom with a hole that the bag can sit upon and the spout insert through. The bottom is sufficiently strong enough to support the supersac, rather than relying on the fabric straps to support the supersac during the filling process.

It is desirable to provide a more efficient and safer process and apparatus for transporting and delivering bulk abrasive media to and reclaiming bulk abrasive media from a job site.

SUMMARY OF THE INVENTION

The subject invention is directed to a new and improved process and apparatus for transporting, handling and recycling bulk abrasive media. A rigid walled hopper replaces the bulk bags or supersacs. The hopper has approximately the same footprint as the typical supersac, but can store a substantially larger volume of the abrasive material. In a typical example, the supersac stores up to 30 cubic feet of abrasive material. The hopper of the present invention can store up 55 cubic feet of abrasive material with the same footprint and height requirements as the supersac. The hoppers can be sealed for protecting the abrasive from rain and from salt spray for offshore applications.

In the preferred embodiment, lifting hooks may be provided on the top of the hopper whereby the hopper may be moved about by an overhead crane. Fork lift pockets are also provided on the base frame of the hopper for facilitating the use of a fork lift to move and position the hopper relative to the blast pot or for moving the hopper between transport systems, storage locations and functional work stations.

Because the hopper is made of a rigid wall configuration, additional guard systems to protect the operator during fill operations.

The supersacs have to be emptied once the chord is removed from the bottom. The hopper of the subject invention has a release valve which may be selectively opened and closed during fill operations, permitting more efficient delivery of the abrasive material to the blast pot.

In the preferred embodiment, the hopper is designed to withstand a vacuum so that used abrasive may be reclaimed into the same container it was shipped in. The vacuum system is designed to minimize carryover from the reclamation line to the vacuum line to minimize flow of the abrasive into the vacuum source.

The hopper system of the subject invention is adapted for both delivery and reclamation of bulk abrasives. The hopper is a closed, vacuum rated container with an inlet port with a hatch which is moveable between an open position for gaining access to the interior of the container and a closed position for closing the container. At its lower end there is an outlet port for releasing the contents of the container. The outlet port includes a valve which is moveable between open and closed positions for controlling the flow of contents from the container. The hopper system includes a connector for attaching a vacuum source to the container and in communication with the interior of the container and a reclamation inlet in the container and communicating with a reclamation line for drawing abrasives into the interior of the container when the vacuum source is attached to the container.

The hopper system container may be of either a rectangular configuration or a rounded configuration. In the preferred embodiment the container is mounted in a frame having legs extending below container. Channel members are attached to the legs and are adapted for receiving the forks of a fork lift for facilitating movement of the container during use. The hopper system may also include lifting hooks attached to an upper portion of the hopper system for facilitating movement of the container during use.

The connector for attaching a vacuum source to the container comprises a pipe having a lower open end extending through a lower wall of the container to the exterior of the container and adapted to be attached to a vacuum source, and an upper open end terminating in the interior of the container near the upper wall. In the preferred embodiment of the hopper system, the upper open end of the container also terminates near a side wall of the container.

The reclamation inlet comprises a reclamation pipe having a lower open end extending through a lower open end extending through a lower wall of the container to the exterior of the container and an upper open end terminating in the interior of the container near the upper wall. The upper open end terminates in a position in alignment with the inlet port.

In the preferred embodiment of the invention, a removable wear plate is adapted to be placed in the container in alignment with and positioned between the inlet port and the upper end of the reclamation pipe for intercepting abrasive which is released by the reclamation pipe into the interior of the container.

DETAILED DESCRIPTION OF THE EXEMPLARY EMBODIMENTS

Figure 1:
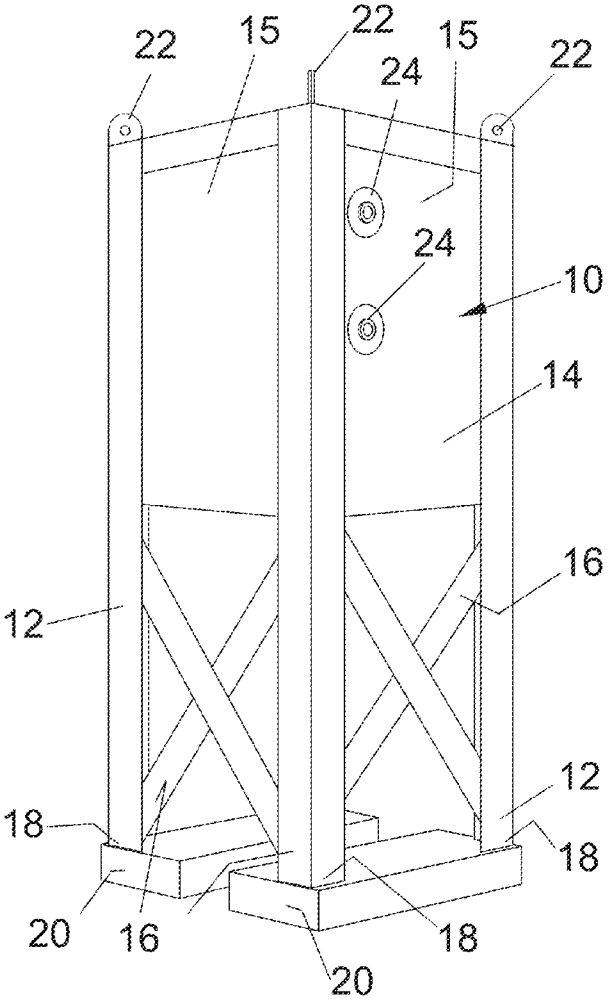
FIG. 1 is a perspective view of the bulk abrasive hopper of the subject invention.
Figure 2:
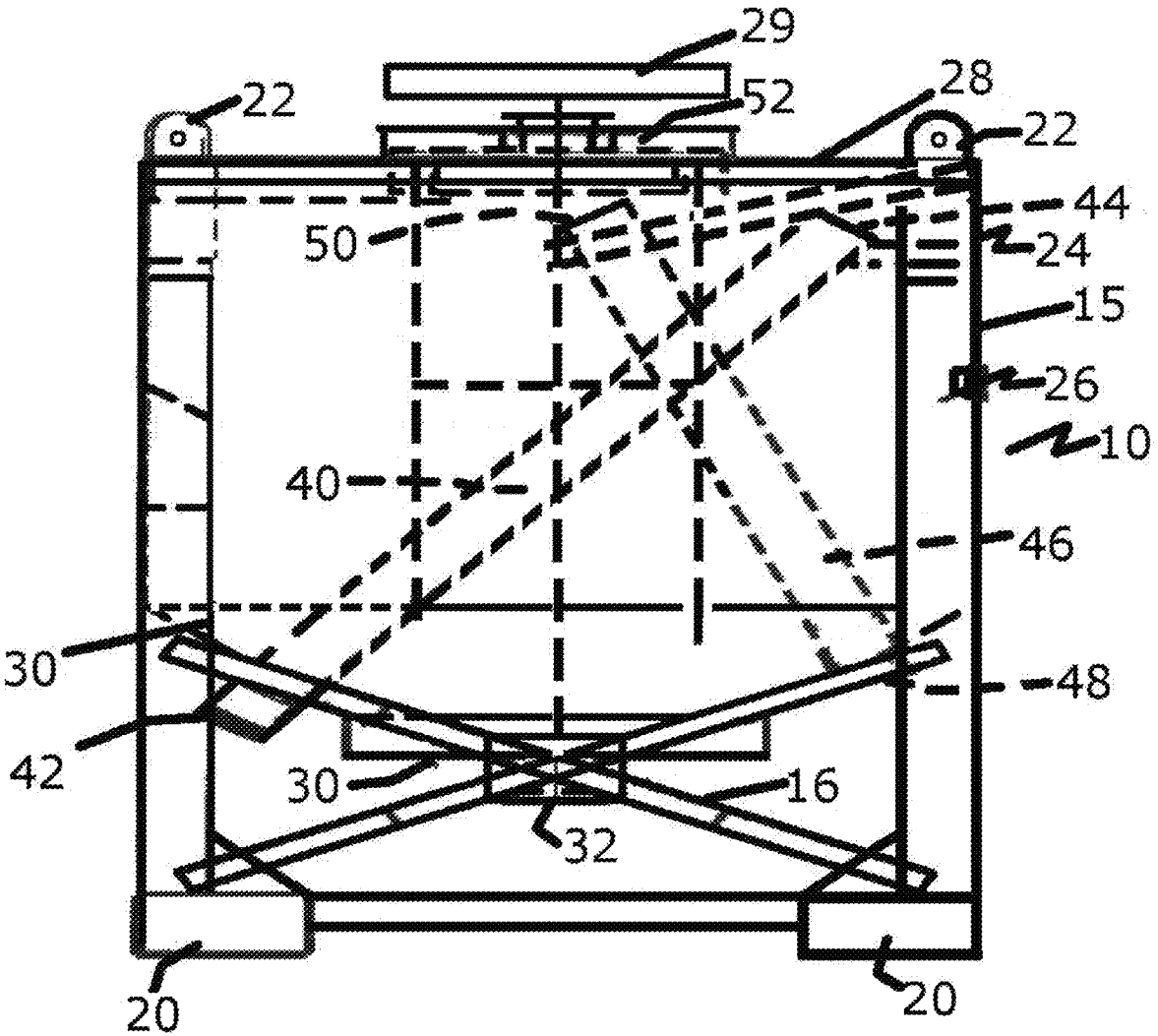
FIG. 2 is a side view of a rectangular hopper system in accordance with the subject invention.
Figure 3:
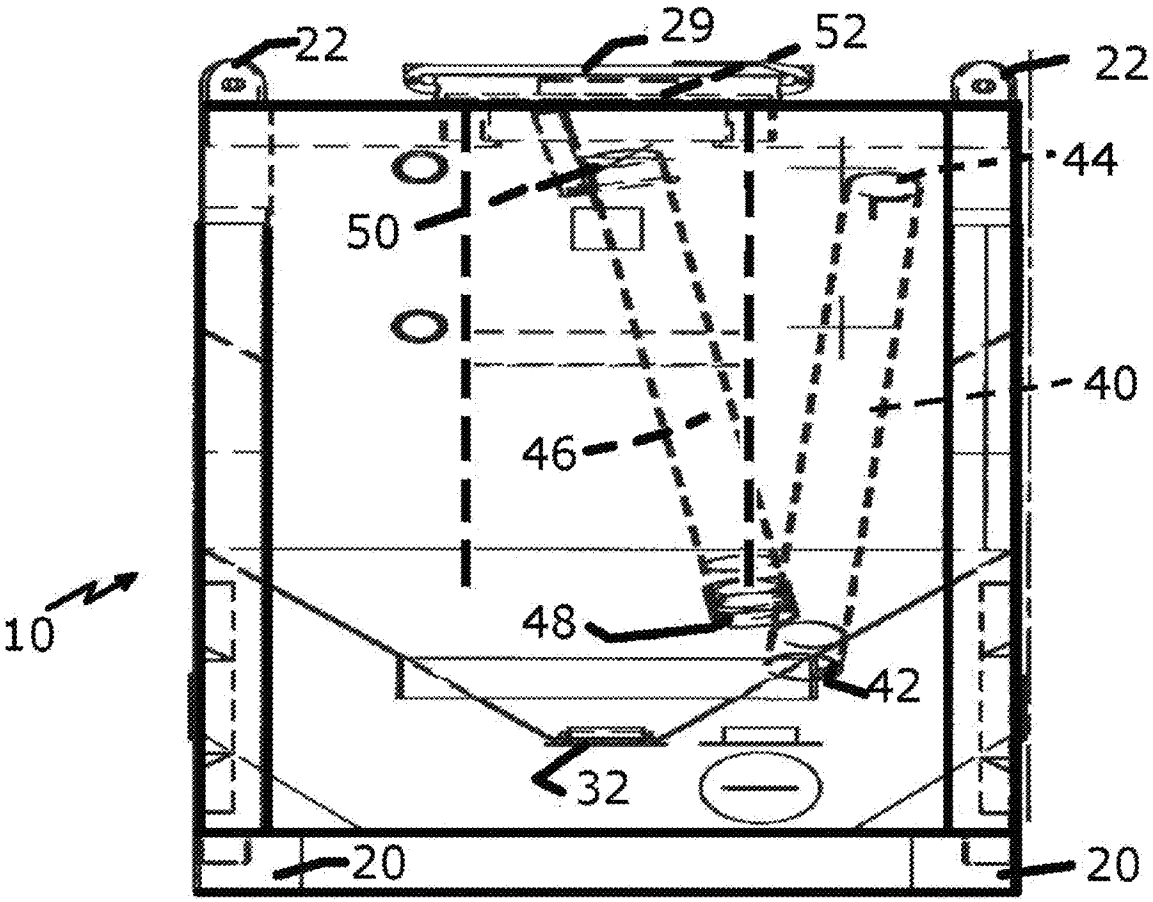
FIG. 3 is a front view of the hopper system shown in FIG. 2.

A rectangular hopper in accordance with the subject invention is shown in FIGS. 1-5. As there shown, the hopper includes an outer frame 10 having upright supports 12 at each corner for supporting the hopper 14. Each of the sidewalls 15 are of rectangular shape. The cross-bars 16 are for added structural strength. The lower end 18 of each upright 12 is secured to a rectangular, open channeled fork pocket 20, whereby the hopper system may be moved about utilizing a standard fork lift. Lifting hooks 22 are secured to the upper ends for the upright supports 12, whereby the hopper system may also be move by an overhead crane or the like. Two sight lenses 24 and 26 are provided in a sidewall of the hopper to provide visual access to the interior of the hopper.

Figure 4:
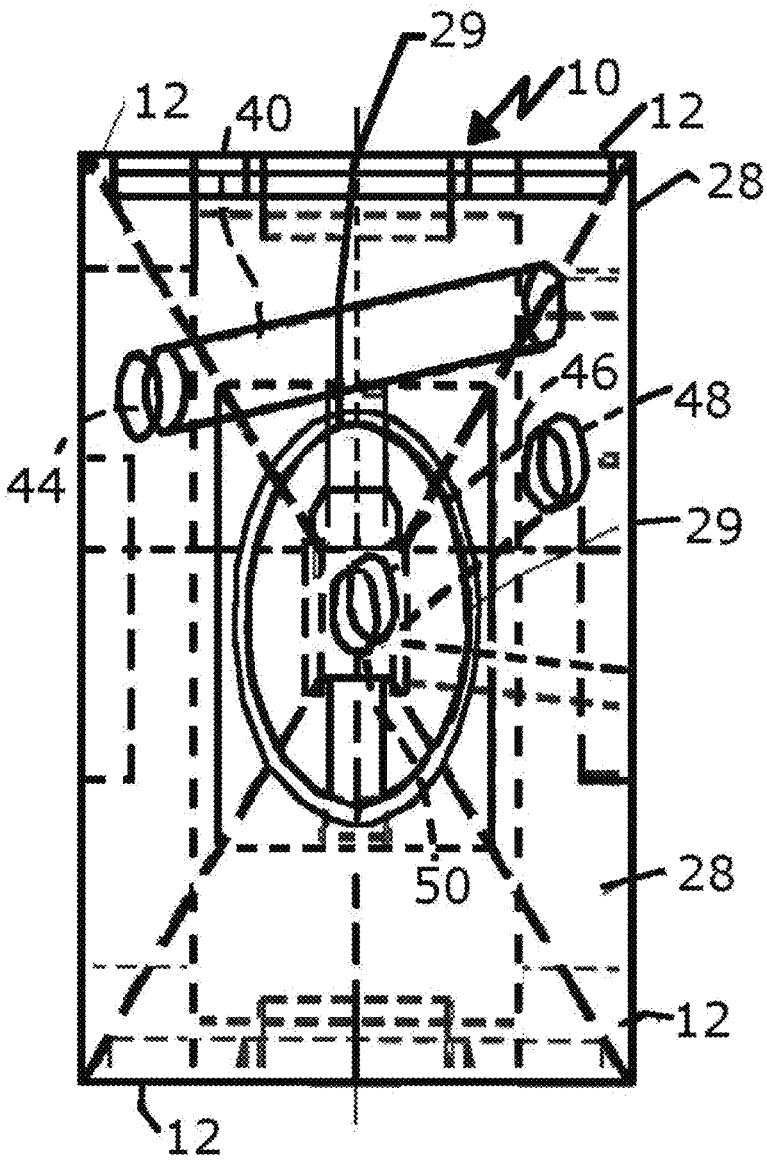
FIG. 4 is a top view of the hopper system shown in FIG. 2.
Figure 5:
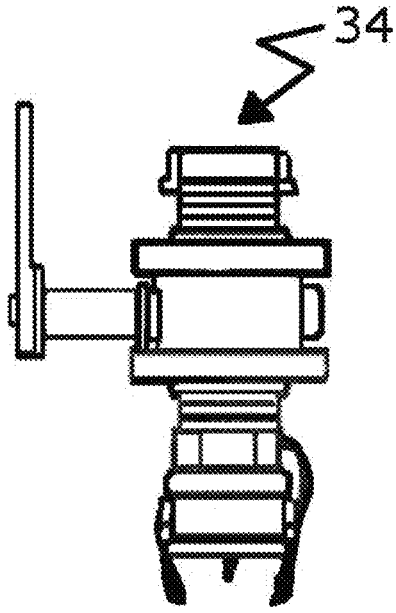
FIG. 5 is the drain valve for the hopper system shown in FIG. 2.
Figure 6:
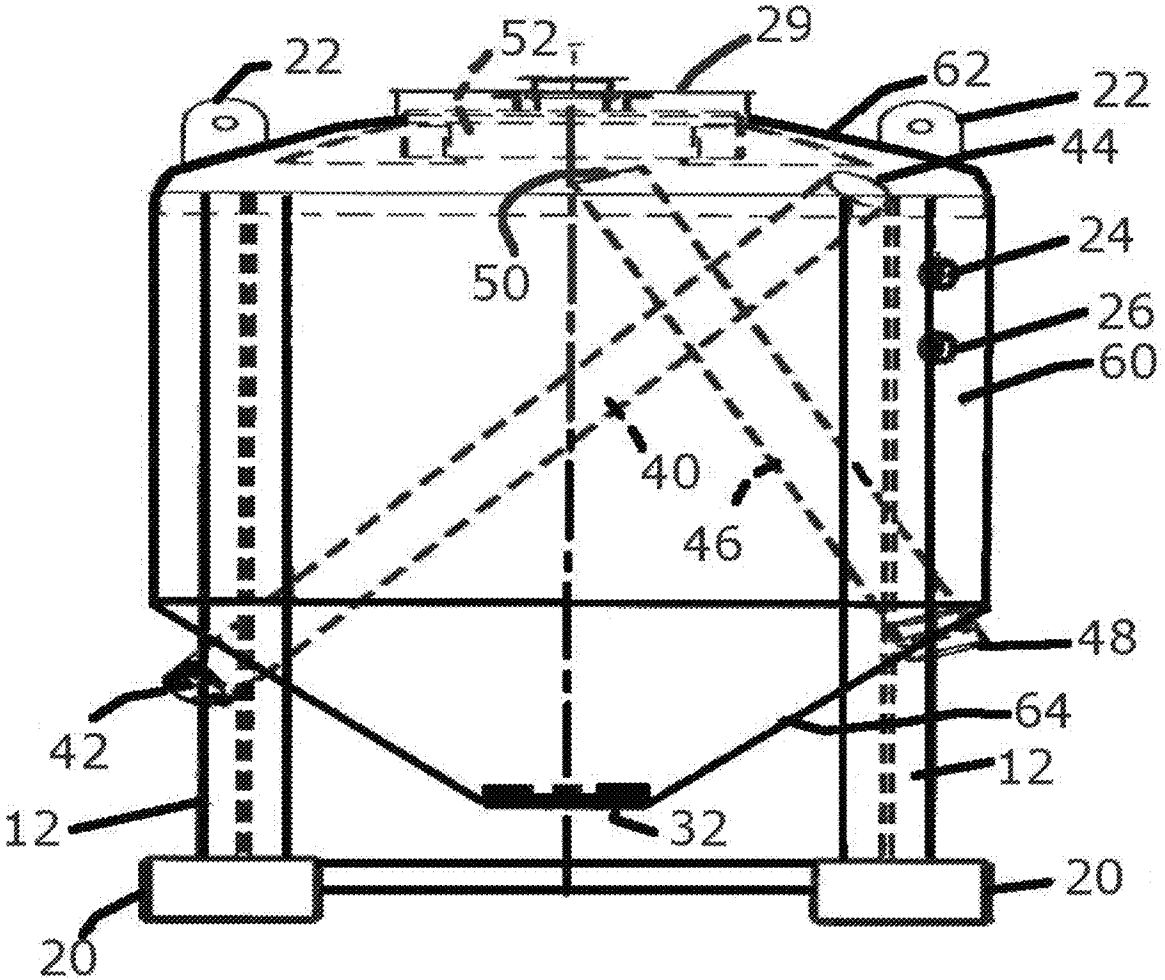
FIG. 6 is a side view of a round hopper system in accordance with the subject invention.
Figure 7:
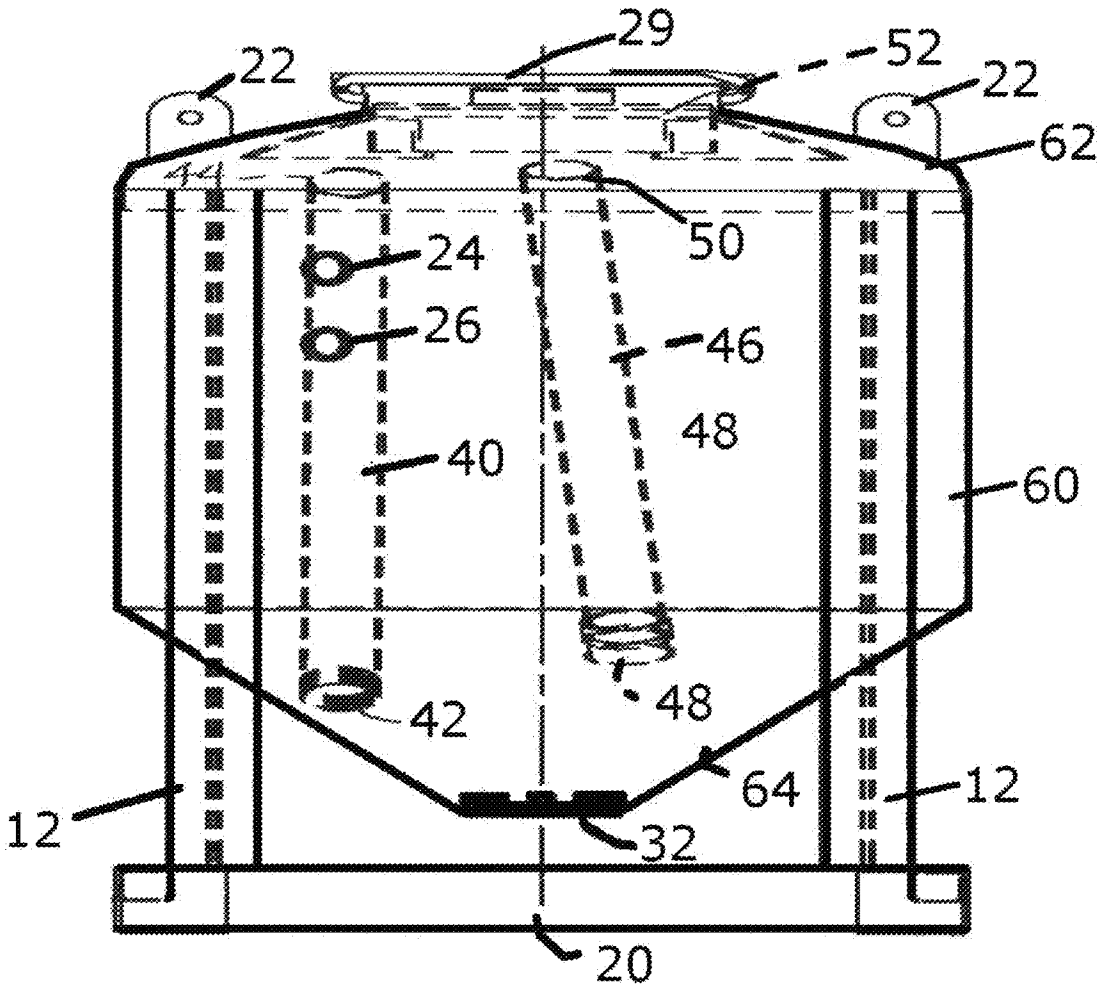
FIG. 7 is a front view of the hopper system shown in FIG. 6.
Figure 8:
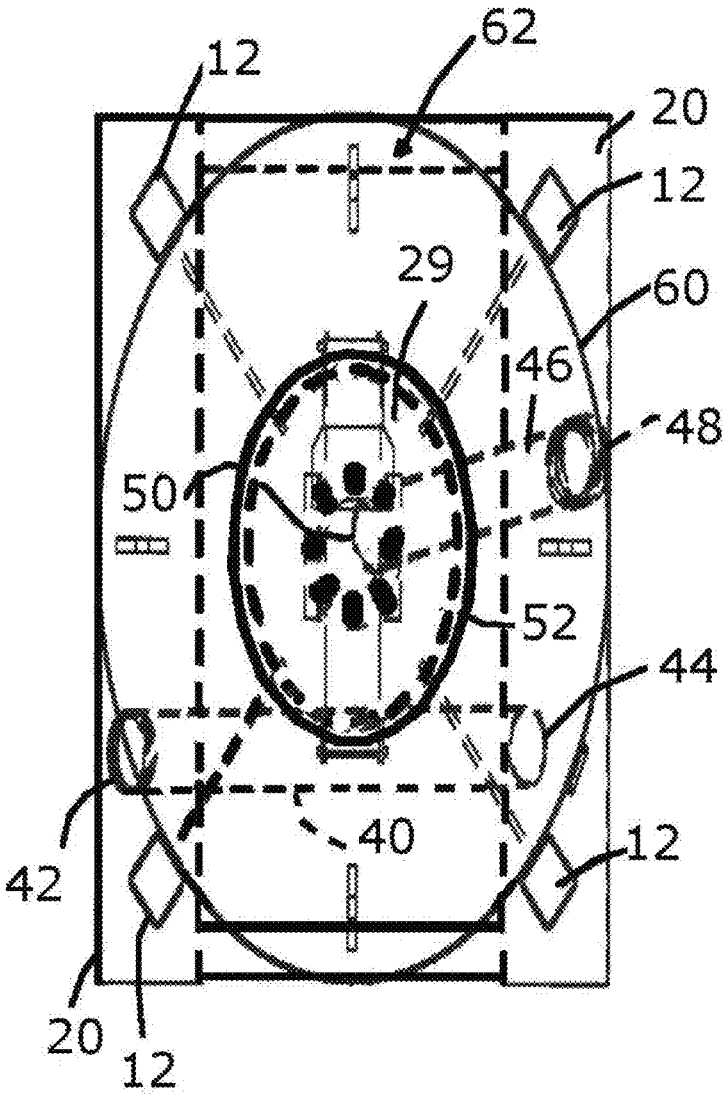
FIG. 8 is a top view of the hopper system shown in FIG. 6.
Figure 9:
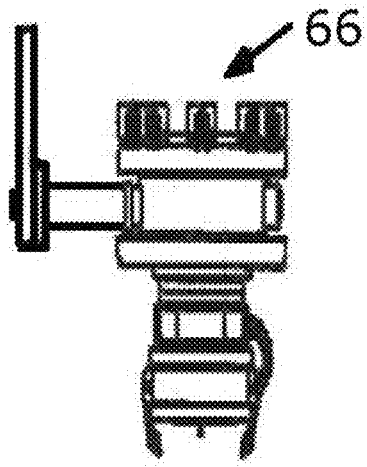
FIG. 9 is the drain valve for the hopper system shown in FIG. 6.

As better shown in FIG. 4, the top wall 28 is also of a flat configuration and includes an access hatch or port 29. The bottom 30 of the hopper is tapered toward a lower outlet port 32, which is the port through which the abrasive material flows from the hopper into a blast pot, not shown. As shown in FIG. 5, a drain valve 34 is adapted to be secured to the outlet port 32. The drain valve may be selectively opened and closed to control the flow of abrasive into the blast pot.

In practice, the hopper system 10 is positioned over a blast pot by a fork lift or an overhead crane and the abrasive material is released into the blast pot through the outlet port 32, as controlled by the drain valve 34.

In the preferred embodiment, the hopper system is vacuum rated when the drain valve 34 and the hatch 29 are closed. This permits the hopper to not only be used as the delivery vessel for delivering abrasive material to a blast pot, but also to be used as the reclamation vessel for recovering spent abrasive and delivering it to a reclamation site. As best shown if FIGS. 2 and 3, a vacuum tube or pipe 40 has a lower end 42 which extends through the bottom wall 30 of the hopper, at a position above the drain port 32. The upper end 44 of the vacuum tube 40 terminates in the hopper near the top wall 28 and near a side wall 15. A reclamation pipe 46 has a lower end 48 which also extends through the bottom wall 30 of the hopper, at a position above the drain port 32. Preferably, but not necessarily, the end 48 of the reclamation pipe 46 is above the end 42 of the vacuum pipe 40. The upper end 50 of the reclamation pipe 46 is positioned in alignment with the hatch 29.

In operation, a vacuum line may be attached to the lower end 42 of the vacuum pipe 40 for drawing a negative pressure on the hopper. An inlet line may be attached to the lower end 48 of the reclamation pipe 46, whereby spent abrasive material may be reclaimed and drawn into the hopper system 10, permitting the delivery vessel to also serve as the reclamation and return vessel for the abrasive material.

The respective upper ends of the vacuum pipe and the reclamation pipe are arranged to minimize carryover, or backflow, of the reclaimed abrasive from the reclamation pipe into the vacuum pipe.

The sight lenses or glasses 24 and 26 permit visual confirmation of the amount of abrasive in the hopper at all times. Ideally, the filled hopper will have an abrasive content between the lower sight glass 26 and the upper sight glass 24.

Figure 10:
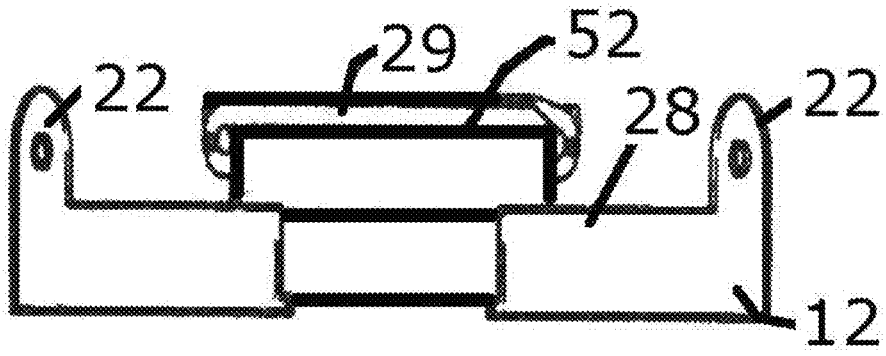
FIG. 10 is a view of the target wear plate positioned in the hopper and in line with the reclamation line outlet.
Figure 11:
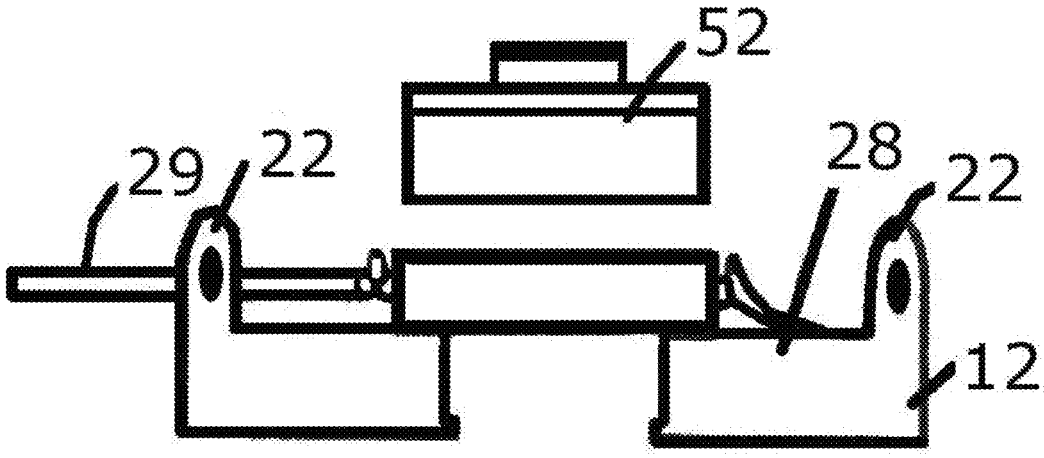
FIG. 11 is a view of the target wear plate of FIG. 10 removed for access to the hopper.

A replaceable wear plate 52 is adapted to be positioned inside the hatch 29 and in alignment with the upper end 50 of the reclamation pipe 46. As reclaimed abrasive is released into the hopper system, it will be directed toward the wear plate 52, minimizing any wear and tear of the primary hopper components. A preferred embodiment of the wear plate is shown in FIGS. 10 and 11. As shown in FIG. 10, when the hatch 29 is closed against the top of the hopper, the wear plate 52 is adapted to be sandwiched between the top of the hopper and the closed hatch 29. As shown in FIG. 11, when the hatch 29 is opened, the wear plate 52 may be removed to provide access to the hopper interior.

As shown FIGS. 6-9, the hopper system may also be of a round configuration. Like reference numerals indicate components which are identical in function with those of the rectangular configuration shown in FIGS. 1-5. The primary distinction between the two configurations is that in the round configuration the sidewall 60 is cylindrical, the top 62 is rounded, and the bottom wall 64 is a truncated cone. The drain valve 66, see FIG. 9, has also been modified to fit the conical bottom wall 64. In operation the rectangular system and the round system work in the same manner.

While certain features and embodiments of the invention have been described in detail herein, it should be understood that the invention encompasses all modifications and enhancements which are within the scope and spirit of the accompanying claims.

What is claimed is:

1. A hopper system for both delivery and reclamation of bulk abrasives, comprising:

a. A closed, vacuum rated container;

b. An inlet port with a hatch which is moveable between an open position for gaining access to the interior of the container and a closed position for closing the container;

c. An outlet port for releasing the contents of the container, the outlet port having a valve which is moveable between open and closed positions for controlling the flow of contents from the container;

d. A first pipe mounted inside the container and having a lower end passing through a lower wall of the container and an upper end terminating inside the container near an upper wall thereof;

e. A second pipe mounted inside the container and having a lower end passing through a lower wall of the container and an upper end terminating inside the container near an upper wall thereof;

f. a connector for attaching a vacuum source to the lower end of one of said pipes and in communication with the interior of the container via the upper end thereof for drawing a vacuum on the container;

g. A reclamation inlet being defined by the lower end of the other of said pipes and in communication with the interior of the container via the upper end of said other pipe for drawing a vacuum on the container and communicating with a reclamation line for drawing abrasives into the interior of the container when the vacuum source is attached to the container via said one of said pipes; and h. A wearplate mounted in the interior of the container near its upper end and positioned such that the wear plate is in alignment with the upper end of said other of said pipes.

2. The hopper system of claim 1, wherein the container is of a rectangular configuration.

3. The hopper system of claim 1, wherein the container is of a rounded configuration.

4. The hopper system of claim 1, wherein the container is mounted in a frame have legs extending below container.

5. The hopper system of claim 4, further including channel members attached to the legs and adapted for receiving the forks of a fork lift for facilitating movement of the container during use.

6. The hopper system of claim 1, further including lifting hooks attached to an upper portion of the hopper system for facilitating movement of the container during use.

* * * * *